United States Patent [19]

Hodges et al.

[11] Patent Number: 4,616,473

[45] Date of Patent: Oct. 14, 1986

[54] APPARATUS TO PLACE MICROFILM FRAMES IN JACKETS

[75] Inventors: Paul L. Hodges, Claremont; David R. Duerr, Sugarloaf, both of Calif.

[73] Assignee: Data Conversion Inc., Pomona, Calif.

[21] Appl. No.: 766,771

[22] Filed: Aug. 16, 1985

[51] Int. Cl.[4] ..... B65B 63/00; B65B 43/26

[52] U.S. Cl. ..... 53/520; 53/570

[58] Field of Search ..... 53/520, 570, 564, 574, 53/384, 479; 83/373, 589, 602

[56] References Cited

U.S. PATENT DOCUMENTS

| | | | |
|---|---|---|---|
| 2,892,295 | 6/1959 | McArthur . | |
| 3,872,645 | 3/1975 | Dorman | 53/570 X |
| 3,896,603 | 7/1975 | Tout | 53/570 X |
| 3,965,556 | 6/1976 | Sanchez et al. | 53/520 X |
| 4,064,677 | 12/1977 | Takahashi et al. . | |
| 4,102,029 | 7/1978 | Thompson . | |
| 4,167,842 | 9/1979 | Dorman | 53/520 |
| 4,231,214 | 11/1980 | Kiejzik | 53/520 |
| 4,258,531 | 3/1981 | Kiejzik | 53/570 X |
| 4,464,881 | 8/1984 | Dorman | 53/520 |

*Primary Examiner*—Horace M. Culver

*Attorney, Agent, or Firm*—Donald D. Mon

[57] ABSTRACT

An inserter for inserting microfilm frames, originally on film strips, into jacket channels, singly or in series. Grip means grips the end of a strip of film and moves a selected frame to a projection station. There the frame is severed, and a pusher inserts it into a jacket channel. The strip and the pusher mutually exclude one another from a channel through which the frames moves toward the jacket.

7 Claims, 5 Drawing Figures

25
28
29
31
43
30
40
42
31

12
22
25
43
37
36
38
40
34
53
5
5
50
41
35
51
64
46
45
52
63
13

20
12
22
23
24
21
25
40
37
44
51
4
64
99
61
63
73
52
76
60
75
96
95
11
10
13

APPARATUS TO PLACE MICROFILM FRAMES IN JACKETS

FIELD OF THE INVENTION

This invention relates to the storage of microfilm frames in jackets, and in particular to apparatus for inserting microfilm frames into jacket channels.

BACKGROUND OF THE INVENTION

"Microfilm frame", as the term is used herein, means a frame or frames of microphotography separated from a strip of a large number of such frames, wherein the frames are originally connected to one another. A common and established means for storage and later viewing of these frames is to place them in transparent jackets through which the images on the frames can be projected. The jackets have a top layer and a bottom layer joined at spaced regions to provide internal channels to receive microfilm frames. A slot is formed in one of the layers at each channel. The objective is to insert the frames singly or in groups through the slots into selected channels. Each frame can then be viewed by projection through the jacket on a reader device.

Inserter mechanisms for microfilm frames are known and are widely used. As they presently exist, they involve some disadvantages which if corrected can lead to substantial savings.

One such disadvantage is the wastage of film which arises from distributing microfilm frames from film strips. Movement of a film strip, and for that matter, film stored on a reel, requires pinch rollers which necessitate at the end of each segment, that there be a "tail" of substantial length. These tails constitute a surprisingly large wastage of film stock, especially on strips which may have only ten frames, and a tail length of perhaps 30% of the total strip length.

In addition, the movement of the frame along the channel is usually caused by being pushed by film behind it. Then the accuracy of positioning may be a function of skillful manipulation of the pinch rollers, rather than by an independant and readily manipulable device.

It is an object of this invention to provide insertion means which requires, at the most, a negligible tail, and which can accurately position one or more frames in a channel by the use of a device which is separate from the film itself.

BRIEF DESCRIPTION OF THE INVENTION

An inserter device according to this invention has a feed structure with a guide passage that is alignable with a channel in a jacket supported on a platform adjacent to the feed structure. The jacket has a slot through one of its faces that is aligned with the guide passage to receive frames.

The structure has a strip passage and a pusher passage. These both smoothly merge with the guide passage and intersect one another at a junction to form an acute angle between them. Grip means is slidably mounted at the film passage. It is adapted to grip an end of a film strip that is slidably fitted in the strip passage to move the film strip toward and away from, and into, the guide passage. A tongue-like pusher member is slidably fitted in the pusher passage. It is adapted so that one of its ends can enter the guide passage to push a cut-off frame into a jacket channel. The strip and the pusher member mutually exclude each other from the guide passage.

The invention will be fully understood from the following detailed description and the drawings in which:

DETAILED DESCRIPTION OF THE INVENTION

Figure 1:
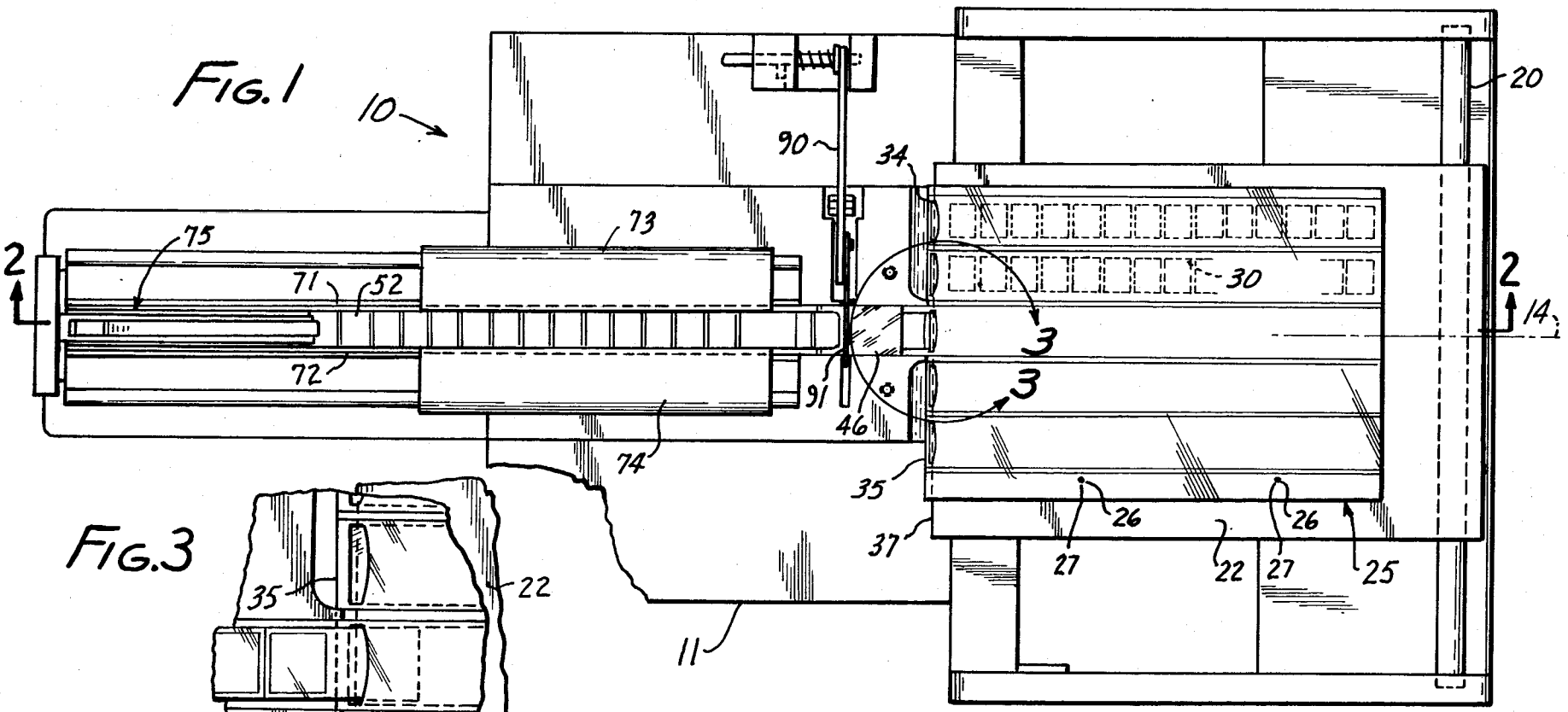
FIG. 1 is a top plan view of the presently preferred embodiment of the invention.
Figure 3:
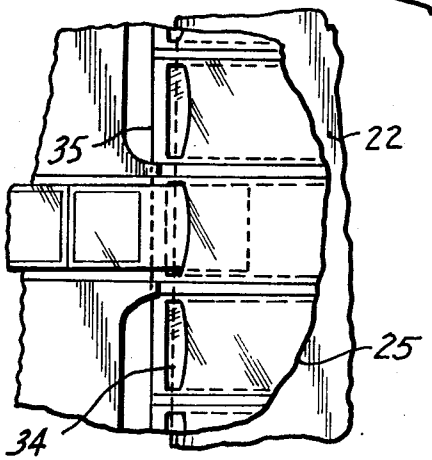
FIG. 3 is an enlarged view of region 3 in FIG. 1.
Figure 5:
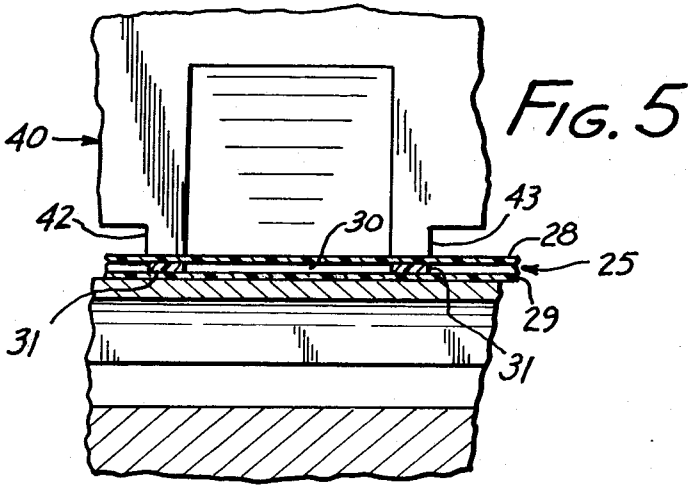
FIG. 5 is a cross-section taken at line 5—5 in FIG. 4.

The drawings show an inserter 10 having a base 11 that supports a platform 12 and a guide structure 13. The apparatus has an axis 14 which is the axis along which a film strip and the microfilm frames move when they are manipulated for insertion.

Platform 12 is pivotally connected to cantilever arm 21 by a hinge pin 20. The arm is directly mounted to the base, and thereby mounts the platform to the base. The platform has a flat upper surface 22, which moves arcuately as shown by arc 23. It is biased upwardly by a bias spring 24 in compression between the under side of the platform and the arm.

The function of the platform is to support and position a jacket 25 on the upper surface 22. Location pins 26 rise from surface 22 to fit in locator holes 27 in the jacket. This positions the jacket relative to the platform, and keeps it from moving around.

Jacket 25 has a top sheet 28 and a bottom sheet 29. In order to form channels 30, the sheets and inserts are bonded to spacer ribs 31 which form side walls of respective channels. The sheets are made of transparent material, so that an image on a microfilm frame between them can be projected.

Entry slots 34 are formed in the top sheet, one for each channel. The slots and the dimensions of width of the channels are slightly larger than the width of the microfilm material. The height of the channel is bit less than the thickness of the microfilm material.

The jacket has an entry edge 35, from which the entry slot is axially spaced. This leaves a flexible portion 36 which can be deflected downwardly over edge 37 of the platform. There is no intended backing for the under side of portion 36. Portion 36 is springly flexible, and as will be shown, simply overhangs edge 37, but is not clamped against it, or against face 38 of the platform.

Figure 4:
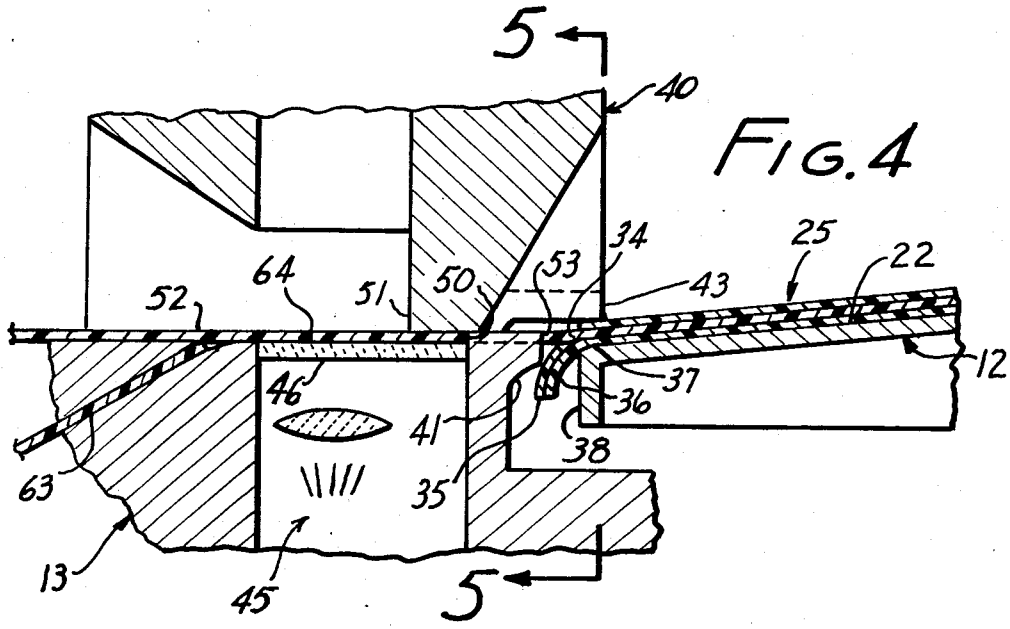
FIG. 4 is an enlarged view of region 4 in FIG. 2.

Feed structure 40 is supported on the base. It includes a deflector lip 41 facing toward face 38 of the platform. When the platform is in the upper position shown in FIG. 4, portion 36 of the jacket will have been brought against the deflector and will have been deflected downwardly by the lip. Notice in FIG. 4 that there is no clamping action on the deflected portion.

A pair of stops 42, 43 face downwardly and overhang the platform away from the edge 35 toward the pivot pin. These limit the upward travel of the platform. The platform is stopped by these stops, with the jacket between them. The stops bear against the jacket at the ribs.

To view the next-to-be inserted of the frames, a projector passage 44 is formed through the feed structure. A projector lamp and lens 45 direct a projection beam upwardly through a window 46 and then to a projection screen (not shown).

A guide passage 50 passes through the guide structure. It passes over, and is bounded in part by, window 46. Side rails 51 receive and guide and support the edges of a strip 52 of microfilm frames. This provides bottom support and edge guidance for the strip. The guide passage opens at its end 53 facing toward the platform at an elevation where frames will be pushed into a slot in the jacket.

A strip passage 60 and a pusher passage 61 are also formed in the feed structure. The function of the strip passage is to hold the strip in alignment with the guide passage so the strip can be inserted into it. The function of the pusher passage is to guide a pusher 63 which will push a cut-off frame into the jacket channel. The strip passage and pusher passage intersect at a junction 64 with the guide passage. They make an acute angle with each other, and merge smoothly with the guide passage for a reason which will become evident. The pusher is flexible and tongue-like. It rides in side rails 51 after it passes the junction of the feed passage and strip passage.

The strip passage has a side rail structure to receive and guide the strip. Lower rail surfaces 71, 72 support the strip from below, and hinged bodies 73, 74 overlay the edges of the strip to form the top of the side rails. They can be turned back to give access, so the film strip can be placed in the strip passage from above.

Grip means 75 comprises a pinch-type clip 76 which is rail mounted to the feed structure for axial movement to grasp and move a strip 52 in the strip passage and in the guide passage. It is a considerable advantage of this invention that only a very small area at the very end of the strip needs to be gripped, and there is no need for a long tail on the strip for engagement by rollers. The grip means is manually opened and closed like a clothespin, and is manually moved along the axis. The proportions of the structure and the grip means are such that the grip means can advance the frame closest to it to a location where the frame rests at projection window 46. Movement of the frame beyond this location is caused by the pusher.

A cutter 90 is pivotally mounted just rearwardly of window 46 (or more properly just rearwardly of the projection station). Its blade 91 will sever the strip being viewed at the projection station. There may be one or more frames ahead of that frame, because if several adjacent frames are to be inserted in the same channel, it is pointless to cut them apart, although they may be if desired.

Figure 2:
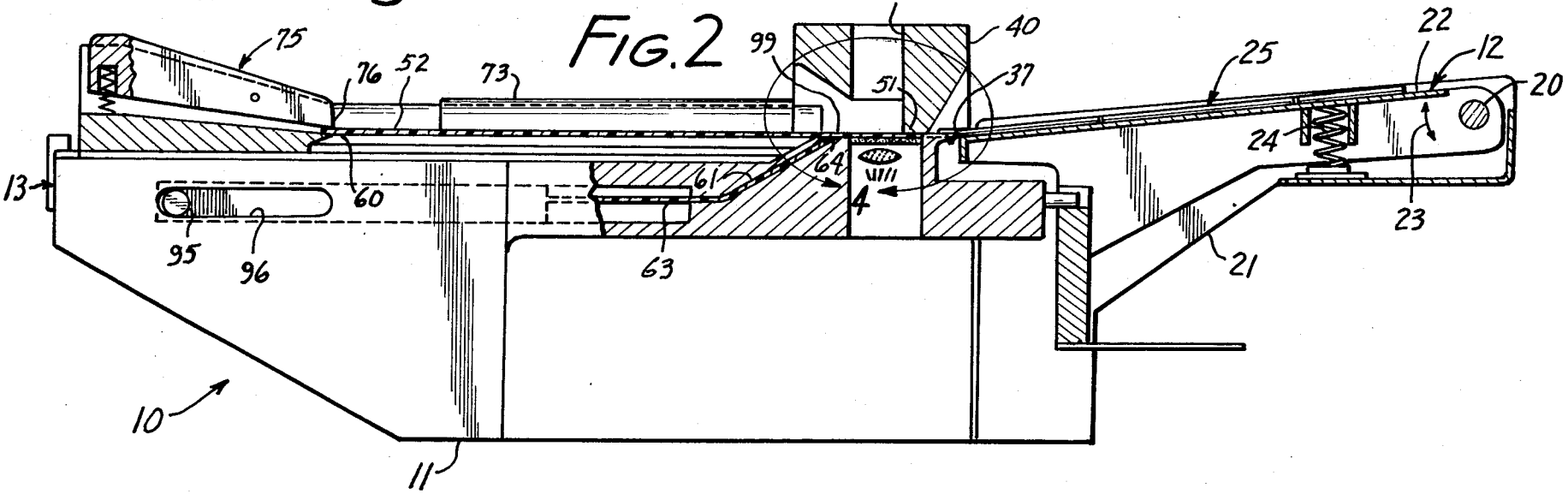
FIG. 2 is an axial cross-section taken at line 2—2 in FIG. 1.

It will be observed in FIG. 2 that when the film strip is at the junction, the pusher is excluded from the guide passage. When the grip means retracts the strip behind the junction, then the pusher can enter the guide passage, contact the trailing edge of the "last" frame and insert it. The pusher is actuated by a post 95 which passes through and slides in a slot 96. The post is attached to the pusher. Its movement is limited by adjustable stops (not shown). The movement permitted by the stops is at least equal to the total movement necessary for the tip end 99 of the pusher to move the last frame from the projector station to the "first" position in the jacket channel. It will also permit the tip end to retreat behind the junction. Thus, each "last" frame will be at the same position in its respective channel when the forward stop is correctly set. The next frame will push the previous frame to a second position when it is inserted into the jacket and so on. Thus the location of each frame can be inventoried and known. The platform is moved sidewardly to place different channels in line with the guide channel.

This invention thereby provides a simple and reliable device for insertion of microfilm frames. It saves the considerable cumulative cost of tails on strips of film, and has an error-free mutual exclusion of film or pusher at the junction. It is easily manipulated, and all cut and insert operations are conducted along the same axis.

This invention is not to be limited by the embodiment shown in the description which is given by way of example and not of limitation, but only in accordance with the scope of the appended claims.

I claim:

1. In apparatus for inserting microfilm frames into a jacket, said jacket being the type having a top and bottom sheet joined to ribs at spaced intervals to leave between them channels having a width for containing microfilm frames, there being an entry slot through one of said sheets for each channel, each microfilm frame having a width somewhat less than the width of the channel, said microfilm frames being initially intended for individual or plural insertion into one or more of said channels, said apparatus including projection means to project an individual microfilm frame, a platform to support a jacket into which a microfilm frame is to be inserted, and a cutter to sever the strip at a selected location, the improvement comprising:

a feed structure having a guide passage therethrough, with which a channel of the jacket will be aligned when a microfilm frame(s) is to be inserted, said guide passage having transverse dimensions such as to guide the microfilm frame along a path toward said channel;

a strip passage and a pusher passage, both smoothly merging with said guide passage and intersecting one another at a junction to form an acute angle between them;

grip means slidably mounted in said strip passage, adapted to grip an end of a strip which is slidably fitted in said strip passage so as to move it toward and away from said guide passage; and a pusher member slidably fitted in said pusher passage and adapted to press against the end of a microfilm frame(s) which is disposed in said guide passage, said strip and said pusher member mutually excluding the other from said guide passage when present at said junction.

2. Apparatus according to claim 1 in which said grip means is a clip which is slidably fitted to said feed structure.

3. Apparatus according to claim 1 in which said pusher member is a flexible strip, and which has a tip end adapted to abut a microfilm frame to move the microfilm frame into a selected channel, said pusher member having dimensions relative to the passages such that said tip end can move from a position inside said pusher passage to a position beyond the guide passage and into the jacket channel.

4. Apparatus according to claim 3 in which said pusher means is a body which is slidably fitted to said feed structure.

5. Apparatus according to claim 1 in which said grip means engages only a minor portion of the length of said strip, and is so disposed and arranged as to be able to move the strip so every microfilm frame may be positioned by it at the projection means, and at the cutter simultaneously.

6. Apparatus according to claim 2 in which the strip passage is partly formed by pivoted elements which can be tipped back to give access for the strip.

7. Apparatus according to claim 2 in which said clip is able to clamp onto an area immediately at the end of the strip and immediately adjacent to a microfilm frame adjacent to said end of the strip.

* * * * *